US011170618B2

(12) United States Patent
Murphy

(10) Patent No.: US 11,170,618 B2
(45) Date of Patent: Nov. 9, 2021

(54) CLIMBING AND INCIDENTAL CONTACT

(71) Applicant: Network Integrity Systems, Inc., Hickory, NC (US)

(72) Inventor: Cary R. Murphy, Hickory, NC (US)

(73) Assignee: Network Integrity Systems Inc, Hickory, NC (US)

( * ) Notice: Subject to any disclaimer, the term of this patent is extended or adjusted under 35 U.S.C. 154(b) by 0 days.

(21) Appl. No.: 16/911,923

(22) Filed: Jun. 25, 2020

(65) Prior Publication Data

US 2020/0410830 A1 Dec. 31, 2020

Related U.S. Application Data

(60) Provisional application No. 62/867,332, filed on Jun. 27, 2019.

(51) Int. Cl.
*G08B 13/12* (2006.01)
*G08B 29/18* (2006.01)

(52) U.S. Cl.
CPC ..... *G08B 13/122* (2013.01); *G08B 29/185* (2013.01)

(58) Field of Classification Search
CPC ..... G08B 13/122; G08B 29/185
USPC ..... 340/511
See application file for complete search history.

(56) References Cited

U.S. PATENT DOCUMENTS

| | | | | |
|---|---|---|---|---|
| 5,602,534 | A * | 2/1997 | Granat | G08B 13/122 174/51 |
| 6,937,151 | B1 * | 8/2005 | Tapanes | G08B 13/124 340/550 |
| 2011/0172954 | A1 * | 7/2011 | Berger | G08B 13/122 702/150 |
| 2017/0193765 | A1 * | 7/2017 | Weese | G08B 29/188 |
| 2020/0098232 | A1 * | 3/2020 | Stefanelli | G08B 13/2491 |
| 2020/0363241 | A1 * | 11/2020 | Anderson | G01D 5/35316 |

* cited by examiner

*Primary Examiner* — Emily C Terrell
(74) *Attorney, Agent, or Firm* — Adrian D. Battison; Kyle R. Satterthwaite; Ade & Company Inc.

(57) ABSTRACT

A method of monitoring a fence or other containments barrier for climbing events by an intruder comprises providing a first and second sensors at different heights on the fence, detecting from each of the sensors signals which are indicative of vibration of the fence, and comparing the signals from the first and second sensors to determine vibration events which change in relation to a height of the intruder on the fence indicative of climbing so as to distinguish climbing events from incidental events and to provide a signal in response thereto.

12 Claims, 5 Drawing Sheets

CLIMBING AND INCIDENTAL CONTACT

This application claims the benefit under 35 U.S.C. 119(e) of U.S. Provisional Application Ser. No. 62/867,332 filed Jun. 27, 2019.

This application relates to a method for monitoring sensor output for evidence of intrusion events for the purpose of separating different intrusion events having different characteristics. This is particularly but not exclusively applicable to monitoring a containment barrier for intrusion. Such a barrier may be a fence but also can include barriers enclosing data networks, wells, railroads, infrastructure and any other structure which requires to be maintained secure from intrusion by an unauthorized person. The containment barrier may be around a perimeter so as to contain the structure or may be a barrier at a specific location to provide prevention through the barrier at that location.

A sensor used to detect a vibration event on the containment barrier can detect an effect by the vibration event on a medium such as current in a wire, optical signals in a fiber, air movement generated by sounds and many other examples.

BACKGROUND OF THE INVENTION

In an environment of increased security, including protection of assets such as data and facilities, a need exists to monitor a fence line or containment barrier against intrusion. In secure installations, such as military bases, prisons, data centers, and other locations where an unauthorized intruder may pose a threat, there is a need to monitor the containment barrier such as a fence.

It is known that fence monitoring systems require high sensitivity to true positive alarms, suppression of false positive alarms and discrimination of the type of event. In particular the system should provide the ability to differentiate between a true climb and other events in the absence of a nefarious attack such as wind disturbing the fence fabric and impact with other objects such as adjacent vegetation or passing animals.

The state of the art is divided into two sections: a physical detection mechanism which is provided by a sensor responsive to the effect on the medium concerned; and detection of actual events and separating them from false alarms using suppression algorithms.

The physical monitoring and detection mechanisms can include two most common methods of electrical and optical. Electrical monitoring and detection typically requires stringing and fastening an electrical cable along the length of the fence or other barrier. This cable is typically optimized for sensitivity to the piezo electric effect, and is monitored by electronics that are intended to detect vibration events by motion, vibration, and deflection of the sensor wire or cable generating piezo-electric currents in the cable.

Optical monitoring and detection typically requires stringing and fastening an optical cable, that is, a cable containing fiber optic fibers, along the length of the fence. This cable is typically optimized for sensitivity to events affecting one of the following optical parameters:

state of polarization as measured by equipment such as a Stokes Polarimeter;

distribution of optical modes within the fiber (modal metric sensing);

changes in fiber length due to compression and expansion, as measured by bulk interferometry (including interferometers such as Sagnac or Michaelson);

or Distributed Sensing such as Distributed Acoustic Sensing (DAS) or Distributed Strain Sensing (DSS) such as with phase sensitive optical time domain interferometry (ϕ-OTDR).

Arrangements using electrical/electronic sensors can thus include piezo-electric, loose tube coax, capacitance or Time Domain Reflectometry (TDR)

Arrangements using fiber optics can use any one of State of polarization (SOP), Distributed acoustic sensing (DAS), Fiber Bragg Gratings (FBG) or Interferometry; or can use modalmetric or Optical Time Domain Reflectometry (OTDR).

The prior art method for detection lies significantly in a simple monitoring of the sensor and detect threshold crossings of amplitude. This, however, offers no discrimination between different event types to detect climb events.

Thus, in the prior art, when an animal contacts the fence, the sensor reports an event. When the animal strikes it repeatedly the event is repeated. When an intruder climbs a fence, the first step creates an event, the second another event, repeated throughout the climb. The prior art cannot distinguish these events.

Attempts to distinguish have been made using mathematical methods to differentiate contact relative to a climb such as by analyzing the repetition rate of the events, however these are easily spoofed by a knowledgeable intruder who mimics wild life contact by adjusting or randomizing the cadence of steps.

SUMMARY OF THE INVENTION

The present invention relates to a method for operating on the signals obtained by the above techniques or signals from other sensors for the purpose of distinguishing between signals indicative of an active event of climbing of the fence by a person and other different non-intrusive events.

It is one object of the present invention to provide a method of monitoring a containment barrier for intrusion events by an intruder comprising:

providing a first sensor at a first location on the containment barrier;

providing a second sensor at a second location on the containment barrier different from the first location of the first sensor;

detecting a plurality of vibration events over a time period caused by repeated contacts with the containment barrier by an intruder;

for each vibration event, obtaining from each of the first and second sensors, first and second signals which are caused by the vibration events on the containment barrier;

comparing the first and second signals from the first and second sensors from a plurality of vibration events;

making a selection from the plurality of vibration events at least one vibration event where there is a difference in the first signal relative to the second signal caused by a difference in a location of the vibration event on the containment barrier;

and in response to said selection of said at least one vibration event generating a signal indicative of an alarm condition caused by said intruder.

Typically but not essentially the containment barrier comprises a fence over which an intruder must climb and the sensors are located at different heights so as to be indicative of climbing events.

Preferably, comparing the signals from the first and second sensors comprises comparing magnitudes of the signals which change in relation to the height of the intruder on the fence.

Preferably, comparing the signals from the first and second sensors comprises comparing portions of frequency spectra of the signals representing a range of frequencies which are substantially attenuated by a material of the fence so as to be indicative of a height of the event on the fence.

In one arrangement, the first and second sensors comprise a common length of fiber optic cable with a sensor interrogator operatively coupled thereto to determine height of the intruder on the fence.

In one arrangement, there is provided a third sensor at a third height on the fence different from the first and second heights. Further sensors each at a different height can be provided to increase resolution for tracking motion across the height of the fence.

In one arrangement, the first and second sensors are operable at different sensitivities so as to distinguish a non-climbing event from a climbing event.

BRIEF DESCRIPTION OF THE DRAWINGS

The invention will now be described in conjunction with the accompanying drawings in which.

In the drawings, like characters of reference indicate corresponding parts in the different figures.

DETAILED DESCRIPTION

Figure 1:
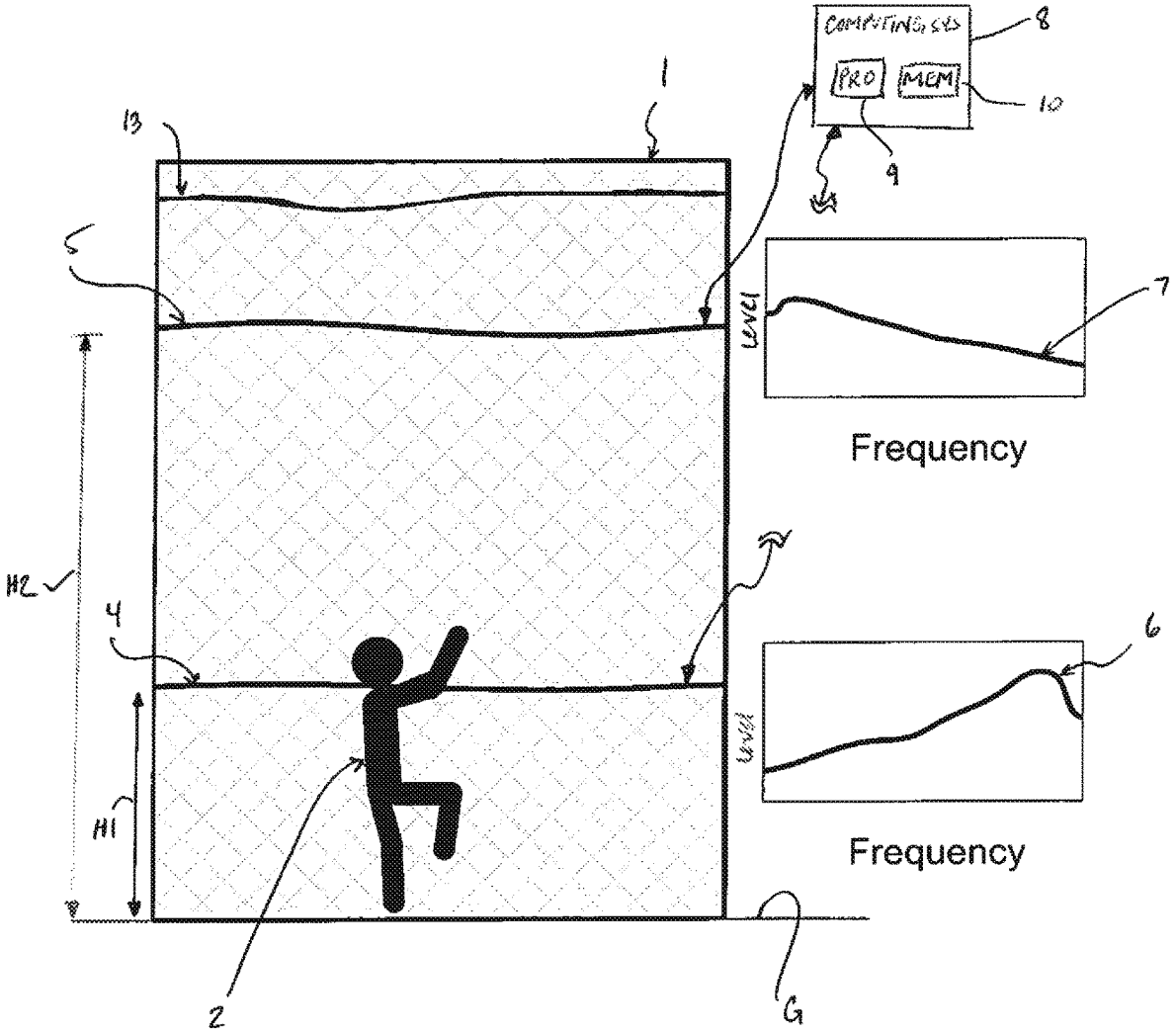
FIG. 1 is a schematic illustration of an intruder climbing a fence with sensors mounted thereon and juxtaposed output signals from the sensors.

With reference to the accompanying drawings, there is disclosed a method of monitoring a fence 1 for climbing events by an intruder 2. On the fence is mounted a first sensor 4 at a first height H1 on the fence, such as relative to a ground surface G, and a second sensor mounted at a second height H2 on the fence different than the height of the first sensor so that the sensors are disposed at spaced locations across the height of the fence 1. In the illustrated arrangement, each of the sensors 4, 5 is formed by a length of fiber optic cable extending substantially horizontally across the fence and carrying a light signal at a prescribed frequency or wavelength which defines a detection medium which is responsive to vibration of the fence 1. The sensors 4, 5 each generate an output signal 6, 7 indicative of vibration of the fence.

With the sensors 4, 5 so provided on the fence 1, both are operatively connected to a computing system 8 comprising a processor 9 and a memory 10, which are operatively interconnected, for detecting and comparing the sensor output signals 6, 7. By comparing the output signals 6, 7, vibration events, which change in relation to a height of the intruder on the fence, can be determined.

More specifically, magnitudes of the signals 6, 7 which change in relation to the height of the intruder 2 can be compared to confirm that it is in fact a climbing event as opposed to for example an animal contacting the fence, which activity typically comprises repeated strikes each generating an event in the signals of the sensors that are similar in magnitude and frequency signature or characteristics. Furthermore, when an intruder climbs a fence, the relative intensity tracks his motion so that the lower sensor signal is stronger than the upper with the relative intensities becoming similar and then reversing as the climbing approaches and crosses the upper sensor. By tracking the relative intensities between the two sensors 4, 5, one can track the progress of the climb by monitoring a series of the vibration events caused by the intruder contacting the fence as they climb. As both sensors 4, 5 are measuring simultaneously, the comparison of relative intensities negates the unevenness of the steps.

Moreover, portions of frequency spectra of the signals 6, 7 representing a range of frequencies which are substantially attenuated by a material of the fence 1 can be compared to detect and track location of the intruder across the height of the fence 1. That is, as different frequencies travel through the fence at different levels of attenuation, the control system can determine motion by analyzing changes in spectra during a climb.

For a fence fabric in which higher frequency vibrations are relatively unattenuated vs lower frequencies, the control system measures the spectra shifting toward the lower frequency when a sensor is approached. Likewise, a fence fabric that transmits lower frequencies more efficiently will see the spectra shift towards the higher frequency.

In FIG. 1, the climber 2 is at the bottom of the fence 1, and, generally speaking, closer to the bottom than to the top where the first sensor 4 is located, and spectra 6, 7 comprise predominately high frequency at lower sensor 4, while low frequencies are predominant at the higher sensor 5 from which the intruder 2 is further away as the high frequencies are attenuated by the fence material.

Figure 2:
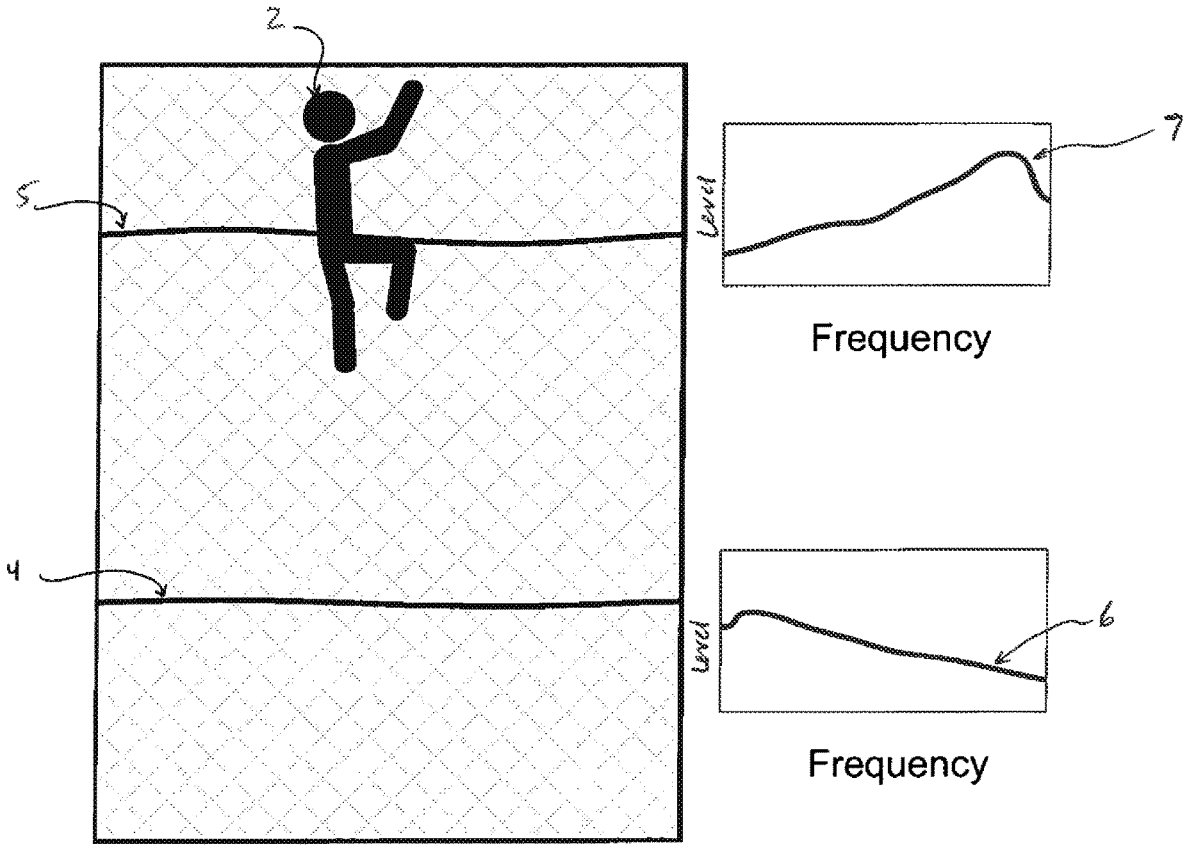
FIG. 2 is a schematic illustration like FIG. 1 except showing the climber at a different height on the fence.

In FIG. 2, the climber 2 is at the top of the fence 1, and, generally speaking, closer to the top than to the bottom of the fence where the second sensor 5 is located, so spectra 6, 7 comprise predominately high frequency at upper sensor 5, and low frequency and attenuated high frequencies at the lower sensor 4.

In one arrangement, with use of a sensor interrogator capable of determining location of the intrusion, a looped back single fiber is used as both sensors 4, 5. In other words, the first and second sensors comprise a common length of fiber optic cable with a sensor interrogator operatively coupled thereto to determine the signal at different locations along the length of the common cable which are related to the height of the sensor on the fence and hence to the height of the intruder on the fence.

To increase resolution and granularity, more than two sensors can be utilized such that, for example, a third sensor 13 is provided at a third height on the fence 1 different from the first and second heights H1, H2 of the sensors 4, 5 as shown in FIG. 1. Again this can be provided by separate sensor cables separately monitored or can be provided by analysis of the vibration of a single cable by a single sensor at different positions along the length of the cable and thus at different heights on the fence.

Separate wavelengths can be used for the two fibers, that is, the first and second sensors 4, 5 are operable at different sensitivities so as to distinguish a non-climbing event from a climbing event.

Furthermore, the analysis of the output signal 6, 7 at each sensor 4, 5 may be multi-layered so as to further detect and differentiate the type of intrusion event from a false alarm. This detection method lies significantly in a simple monitoring of the sensor and detecting threshold crossings of amplitude. Normally, however, such a method offers no discrimination between different event types such as cut, climb, and wind events.

Thus, the detection method is multi-layered, and layer 1 thereof consists of two algorithms including a time domain discrimination algorithm and a frequency domain algorithm.

Figure 3:
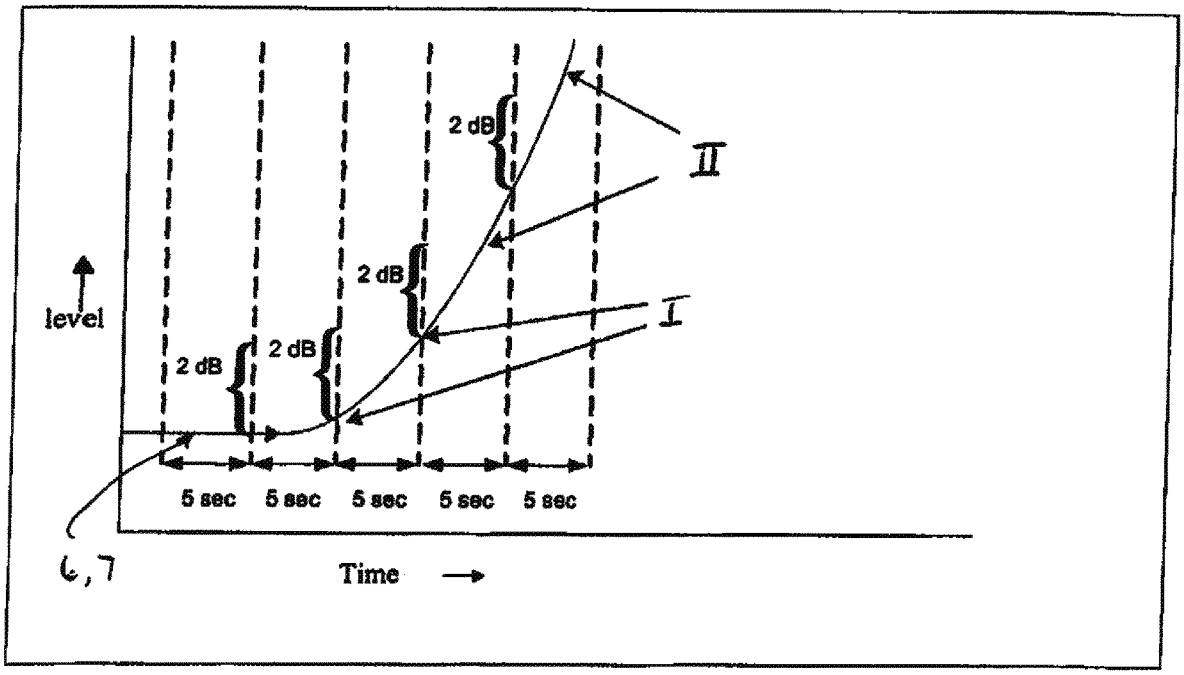
FIG. 3 is a graph of amplitude v time for the signal over a number of time bands.
Figure 4:
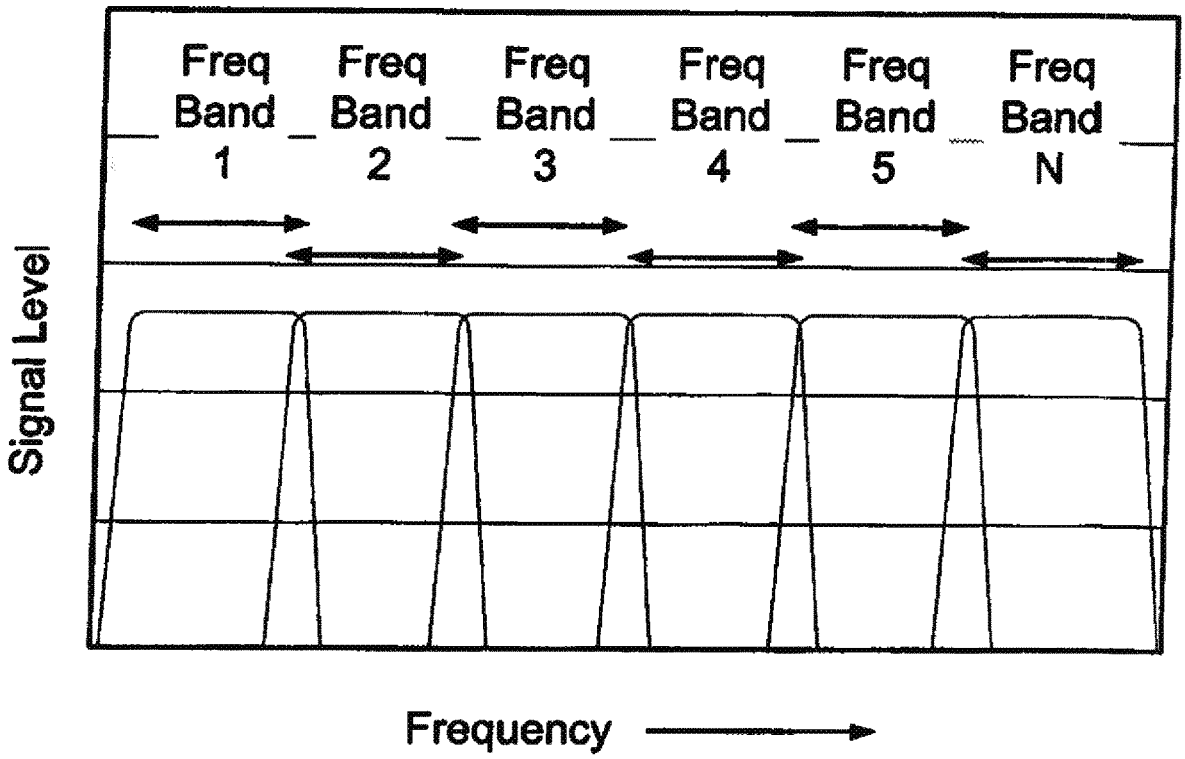
FIG. 4 is a graph of amplitude v frequency for the bands.

The time domain, at its root level, detects the change in amplitude of the detection signal as a function of time. That is, it monitors absolute change over a time slice, as illustrated in FIG. 3. FIG. 3 shows a level in decibels (dB) of the detection or output signal 6 or 7 over time. One key feature of this analysis is that the signal in respect to time should display a step function as shown in the Figures where the signal moves in location or height from level A to level B in a set period of time. For example, in order to be considered a step function, the level of the signal should increase by a prescribed threshold of 2 dB over a prescribed time interval of for example five seconds, that is when comparing the level at the beginning of the period as indicated at I and at the end thereof as indicated at II. Generally the control system will check whether the signal level has exceeded the threshold within the prescribed time interval. This allows the distinction to be made between the event types and the false alarms as the event type to be determined is required to meet this step function.

The frequency domain algorithm does a frequency analysis of the signal from each sensor, such as a Fast Fourier Transform. This frequency envelope is partitioned into multiple sections that correspond to the primary frequencies for each event type. That is, prior analysis of each event type to be detected is carried out to determine time and frequency characteristics of the event. For example, crossover points at 50 Hz and 500 Hz, as shown:

This control system utilizes a combination of events in a multi-dimensional matrix that analyzes one or more of: relative amplitude of each frequency, the duration of each detected event, the repetition rate of said event, the period over which this event occurs, and the presence or absence of a time domain step function.

As tabulated below:

| | Relative Amplitude per Freq Band Scale 1-10 | | | | | Event | Repetition | Repetition | Presence of Time |
|---|---|---|---|---|---|---|---|---|---|
| | F1 | F2 | F3 | F4 | FN | Duration | Rate | Period | Domain |
| Wind | 1-10 | 1-10 | 1-10 | 1-10 | 1-10 | A Sec | B Hz | C Hz | scale 1-10 |
| Climb | 1-10 | 1-10 | 1-10 | 1-10 | 1-10 | L Sec | M Hz | N Hz | scale 1-10 |
| Cut | 1-10 | 1-10 | 1-10 | 1-10 | 1-10 | X Sec | Y Hz | Z Hz | scale 1-10 |

For example, a person climbing a fence might step every 1.5 second, with an event lasting 500 mS, over the course of several seconds, with a heavy emphasis on the mid frequencies and presence of a time domain step function.

In another example, a person cutting the fence might show a clip every 500 mS, with an event lasting 100 mS, over the course of tens of seconds, with a heavy emphasis in high frequencies and an absence of a step function.

This interaction of the data allows the system to:

1) Send out alerts that an unknown episode is occurring on the fence as soon as a signal is received indicative of a potential event.

2) After the appropriate time, the system indicates the type of alert concerned such as cut or climb. This is carried out by the analysis herein wherein signal is analyzed for the frequency and time characteristics of the event type.

3) The same analysis allows the analysis to exclude certain events as false alarms if they do not meet the frequency and/or time characteristics determined for the event types.

This methodology can be expanded to accommodate other alarms or variables:

The characteristics of the event types can include many or few frequency bands of potentially varying widths.

The time characteristics of each event type can include more granularity in the time domain that monitors attributes such as repetition rate and period, including a multiple step envelope function showing rise, sustain, and fall times and rates.

The arrangement herein is not limited to sensors which generate signals by optical fibers or other conducts and can use other types of sensors which generate a detectable signal in response to other detectable events such as door opening, manhole cover lift, digging a hole.

Figure 5:
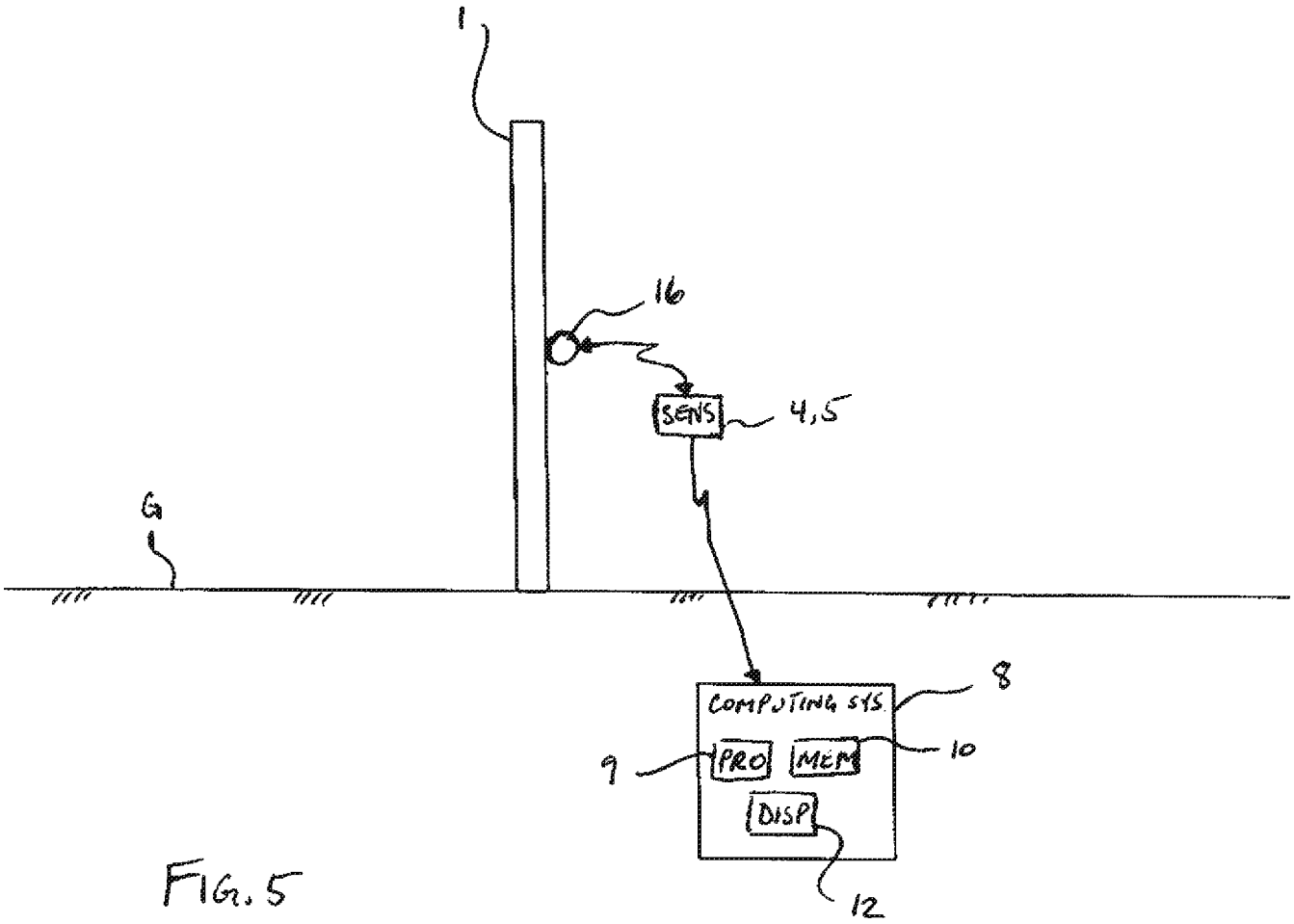
FIG. 5 is a schematic diagram of an arrangement of medium and sensor in which the method of the present invention may be applied.

FIG. 5 schematically illustrates an example of system which can perform the method of detecting intrusion events described hereinbefore. In this example the containment barrier being monitored is a fence 1 standing upwardly from ground surface G. A detection medium 16 for example light carried by a fiber optic cable is operatively coupled to the barrier so that so that changes in a condition of the barrier marked by a potential intrusion event, for example vibration thereof which differs from an anticipated normal stationary condition of the barrier, acts to effect changes in the detection medium 16. A sensor 4 or 5 is operatively connected to the detection medium 16 to respond to those changes to generate an output signal indicative of the changes in the medium 16. The sensor 4 or 5 also is operatively connected to a computing system 8 such that the computing system can receive the output signal for analysis. The computing system 8 generally comprises a processor 9 and a memory 10 which are operatively interconnected. The computing system 8 conducts the analysis which includes an analysis in each of the time and frequency domains. The time domain analysis is used to determine whether the output signal includes a step function which normally is indicative of a potential intrusion event. If there is no such step function in the signal then this likely corresponds to a false alarm. The frequency analysis is used to identify further characteristics of the potential intrusion event. After the time and frequency domain analyses are completed the time and frequency characteristics are compared to a predetermined matrix or data table of the same types of time and frequency characteristics of a plurality of possible intrusion events. By comparison to these values in the matrix/table it can be determined what the potential intrusion event is, or whether it is a false alarm if the characteristics derived from the analysis of the potential intrusion event do not suitably match any set of values in the matrix. The computing system 8 is further arranged for indicating to a user what type of intrusion event has been detected, including whether this is a false alarm, for example by display 12.

The scope of the claims should not be limited by the preferred embodiments set forth in the examples but should be given the broadest interpretation consistent with the specification as a whole.

The invention claimed is:

1. A method of monitoring a containment barrier for climbing events by an intruder comprising:

providing a first motion sensor at a first height on the containment barrier;

providing a second motion sensor at a second height on the containment barrier different from the first height of the first sensor;

the first and second motion sensors providing respective first and second output signals responsive to motion events, which motion events are caused by vibration and/or deflection of the containment barrier generated on the containment barrier by a climbing event of an intruder climbing the containment barrier;

detecting a plurality of the motion events over a time period caused by repeated contacts with the containment barrier by the intruder;

for each motion event, obtaining using a control system from each of the first and second motion sensors, said first and second output signals which are caused by the motion events on the containment barrier;

comparing using the control system the first and second output signals from the first and second motion sensors from a plurality of the motion events;

making a selection using the control system from the plurality of motion events of at least one motion event where there is a difference in the first output signal relative to the second output signal caused by a change in height of the motion event on the containment barrier;

where the change in height is caused by the climbing event;

and in response to said selection of said at least one motion event using the control system to generate a signal indicative of an alarm condition caused by said climbing event by the intruder.

2. The method of claim 1 wherein comparing the output signals from the first and second motion sensors comprises comparing magnitudes of the output signals which change in relation to the height of the intruder on the containment barrier.

3. The method of claim 1 wherein comparing the output signals from the first and second motion sensors comprises comparing portions of frequency spectra of the output signals representing a range of frequencies which are substantially attenuated by passage through a material of the containment barrier.

4. The method of claim 1 wherein the first and second motion sensors comprise a common length of fiber optical cable with a sensor interrogator operatively coupled thereto.

5. The method of claim 1 further including providing a third motion sensor at a third height on the containment barrier different from the first and second heights.

6. The method of claim 1 wherein the first and second motion sensors are operable at different sensitivities so as to distinguish a non-climbing event from said climbing event.

7. The method of claim 1 wherein the containment barrier comprises a fence.

8. The method of claim 1 wherein a single motion event is analyzed by the control system to determine a location of the single motion event on the containment barrier.

9. The method of claim 1 wherein the control system operates also for monitoring of an amplitude of at least one of said first and second output signals of the first and second motion sensors and detecting threshold crossings of the amplitude.

10. The method of claim 1 wherein the control system operates using a time domain discrimination algorithm and a frequency domain algorithm.

11. The method of claim 10 wherein the frequency domain algorithm does a frequency analysis of the first and second output signals, where a frequency envelope is partitioned into multiple sections that correspond to the primary frequencies for each event type.

12. The method of claim 11 wherein the control system uses a combination of events in a multi-dimensional matrix that analyzes one or more of:

relative amplitude of each frequency, a duration of each detected event, a repetition rate of said detected event, the period over which this detected event occurs, and the presence or absence of a time domain step function.

* * * * *